US008298089B2

(12) United States Patent
Merati et al.

(10) Patent No.: US 8,298,089 B2
(45) **Date of Patent: *Oct. 30, 2012**

(54) SYSTEMS AND METHODS FOR SERVER BASED LOTTERY AND CASINO GAMING MACHINES INCLUDING A REMOTE DISPLAY

(75) Inventors: Bruce Merati, San Diego, CA (US); Robert J. Piechowiak, Las Vegas, NV (US); Roger H. Goeb, Las Vegas, NV (US)

(73) Assignee: Next Gaming LLC, Las Vegas, NV (US)

( * ) Notice: Subject to any disclaimer, the term of this patent is extended or adjusted under 35 U.S.C. 154(b) by 266 days.

This patent is subject to a terminal disclaimer.

(21) Appl. No.: 11/779,326

(22) Filed: Jul. 18, 2007

(65) Prior Publication Data

US 2008/0064479 A1 Mar. 13, 2008

Related U.S. Application Data

(63) Continuation-in-part of application No. 11/531,566, filed on Sep. 13, 2006, now abandoned.

(51) Int. Cl.
*A63F 9/24* (2006.01)

(52) U.S. Cl. ..... 463/43; 463/16; 463/17; 463/18; 463/19; 463/20; 463/25; 463/26; 463/41; 463/42

(58) Field of Classification Search ..... 463/16–20, 463/25, 41–43
See application file for complete search history.

(56) References Cited

U.S. PATENT DOCUMENTS

| | | | | |
|---|---|---|---|---|
| 6,652,378 | B2 * | 11/2003 | Cannon et al. | 463/20 |
| 2002/0107072 | A1 * | 8/2002 | Giobbi | 463/42 |
| 2003/0083943 | A1 * | 5/2003 | Adams et al. | 705/14 |
| 2006/0264256 | A1 * | 11/2006 | Gagner et al. | 463/20 |
| 2008/0125219 | A1 * | 5/2008 | Williams et al. | 463/31 |

OTHER PUBLICATIONS

AVG ref1: http://www.freelists.org/old-lists/blind_geek_zone/02-2007/msg00000.html.*

AVG ref2: http://forums.cnet.com/5208-12546_102-0.html?forumID=133&threadID=272746&messageID=2634783.*

Texas Instruments, "SMJ320C80, Digital Signal Processor," SGUS025B—Aug. 1998—Revised Jun. 2002, IEEE Standard 1149.1-1990, IEEE Standard Test Access Port and Boundary-Scan Architecture, Copyright 2002 Texas Instruments Incorporated, pp. 1-157.

(Continued)

*Primary Examiner* — Sunit Pandya
(74) *Attorney, Agent, or Firm* — Thibault Patent Group

(57) ABSTRACT

In one aspect a switch can be placed on any existing video gaming machine. A player can be informed that they have the option to play other games on the video gaming machine. The switch can be either an icon on the video gaming machine's video or a physical switch. Once the player touches the icon or presses the physical switch as an indication of his or her interest to play other games a server can take control of the video display and its touch screen. Similarly, when the player is playing any of the additional games available on video gaming machine, there will be an icon or a switch button to offer the option to go back to the slot's original game.

29 Claims, 6 Drawing Sheets

OTHER PUBLICATIONS

NXP founded by Philips, "SAA7115—PAL/NTSC/SECAM video decoder from NXP Semiconductors," Copyright 2006-2009 NXP Semiconductors, http://www.nxp.com/#/pip/pip=[pip=PIP_8]|pp=[t=pip,i=PIP_8]|[7/11/2009 11:40:50PM], pp. 1-3.

NXP founded Phlips, "Digital Video Decoders for general applications," Copyright 2007 NXP B.V., www.nxp.com, Date of release: Mar. 2007, Document order No. 9397 750 15904, printed in the Netherlands, pp. 1-2.

Texas Instruments, "Other TMS320™ DSPs—TMS320C8X DSPs—SM320080—TI.com," Copyright 1995-2009 Texas Instruments Incorporated, http://focus.ti.com/docs/prod/folders/print/sm320c80.html [7/11/2009 11:34:55 PM], pp. 1-4.

Shearwater Technology, Inc., Technology Tested. OEM Focused. "Griffin™ $TMS_{320}C80$ Parallel DSP for PCIbus," www.shearwatertech.com, Littleon, MA, GRP.9.10.6.E, pp. 1-4.

Texas Instruments, "Digital Signal Processing (DSP) Applications Processors TMS320 DaVinci OMAP Development Tools I Texas Instruments," Copyright 1995-2009 Texas Instruments Incorporated, http://focus.ti.com/dsp/docs/dsphome.tsphome.tsp?sectionID=46&DCMP=TIHomeTracking&HQS=Other+OT+home_p_dsp[7/11/2009 11:59:01 PM], p. 1.

* cited by examiner

SYSTEMS AND METHODS FOR SERVER BASED LOTTERY AND CASINO GAMING MACHINES INCLUDING A REMOTE DISPLAY

RELATED APPLICATIONS INFORMATION

This application claims priority as a Continuation-In-Part under 35 U.S.C. §120 to U.S. patent application Ser. No. 11/531,566 filed Sep. 13, 2006 and entitled "Systems and Methods for Server Based Lottery and Casino Gaming Machines," which is incorporated herein by reference as if set forth in full.

BACKGROUND

1. Field of the Invention

The field of the invention relates generally to casino and lottery gaming, and more particularly to casino and lottery video game machines.

2. Background of the Invention

Slot Machines originally started as mechanical devices. About 25 years ago the manufacturers started adding micro chips to improve production and maintenance cost of the mechanical slot machines. The manufacturers used the micro chips to develop either video games that imitated the reels of a slot machine, or used micro chips to replace the mechanical apparatus that controlled the movement of the reels. These two different types of products thrived independently to the point that you can now find both types, i.e., reel slots and video slots, side-by-side in many casinos.

Reel games can be restricted by the number of reels and number of symbols on each reel. A casual player who makes infrequent visits to a casino may prefer the simplicity of a reel game, while a frequent slot player may prefer a video slot with multiple win combinations. Accordingly, in some cases, video slot machines can be computerized games with more pay combinations, which can be more complicated to comprehend than reel games. The industry has also developed bonus games which are added to the base game of either a reel or a video slot machine. Bonus games can, for example, be included in a second monitor that physically resides on the top of the base game. The bonus or second game is usually activated by a certain event happening at the base game to provide excitement of additional winnings or jackpots.

Over the years, casinos profited from slot machines more than their traditional table games to the point that more than 80% of casinos' revenues and profits are now from slot machines. Due to regulatory reasons, enhancements in casino slot machines based on computer technology advancement have been limited, at least in land based casinos. So far such enhancement has been limited to embedding a Random Number Generator (RNG) as well as the rules and graphics of a game into a microchip. This "gaming chip" is placed into a computer board that, for security and fraud control, is locked into a slot machine cabinet. The integrity of the slot machine is then approved by an independent gaming lab before the machine is placed into service on a casino's floor.

For timely reporting and fraud control purposes the industry has developed casino slot systems that interact with the various components included in a slot machine including, the gaming chip, the devices that accepts moneys, e.g., a coin acceptor, bill validator and/or ticket-in reader; the devices that disperses moneys, e.g., a hopper and/or ticket-out printer; an input device; configured to transmit the players selection to the gaming chip, such as a touch screen and/or a touch sensitive input device connected to the computer board; and the video game's display monitor.

Slot manufacturing is dominated by a handful of companies, the strict licensing and investigation process has created a high barrier of entry and a cozy environment for existing companies licensed to do business in regulated gaming markets. Despite the casino's pressure for system standardization, slot manufacturers have managed to keep their own proprietary systems. The only common protocol currently available is SAS, which interfaces with different manufacturers' slot machines to give the casinos a single reporting system for different manufacturers' machines.

Recently gaming regulations were introduced to address computer security and integrity of a gaming network allowing server based slot machines, where the RNG and the gaming content resides on the server and the slot machine is a simple computer terminal configured to allow access to and delivery of any game available on the server. None of the gaming manufacturers have, however, introduced server based gaming systems, because this will change their pricing model from selling high margin cabinets to content, a business model that they are not yet ready for.

SUMMARY

In one aspect a switch can be included in a video slot machine. A player can begin playing on the slot machine, the player can be informed that they have the option to play other games than the one provided by the machines own gaming board. For example, the switch can be an icon on the video gaming machine's remote video display or a physical switch. Once the player touched the icon or presses the physical switch as an indicator of his or her interest to play other games, a server can take control of the video display and its input device, e.g., a touch screen. Similarly, when the player is playing any of the additional games available via the server an icon or switch button can be included to offer the option to go back to the slot machine's original game or games.

In one aspect, when a player opts out of the original game on a casino video gaming machine to play another game, a computer, e.g., a centralized server or a computer residing in the slot machine, will get from the casino slot system, the player's money balance prior to making the change. All the player's winnings and losses while playing the new game or games will be recorded in the new gaming system and communicated to casino slot system according to its protocol. As soon as the player decides to get back to the original game or as soon as he/she decides to cash out, the server or servers will report the player's money balance back to the original board through the casino slot system.

A casino gaming machine can include any of the various casino style games such as slots, keno, bingo, poker, and any game of chance or skill, whether the game is a video or a reel based game, or is the main game or a bonus round. Additional games can include any of the various casino style games such as slots, keno, bingo, poker, and any game of chance or skill, whether the game is a video or a reel based game. Further, the game can be a main game or a bonus round game.

These and other features, aspects, and embodiments of the invention are described below in the section entitled "Detailed Description."

BRIEF DESCRIPTION OF THE FIGURES

Features, aspects, and embodiments of the inventions are described in conjunction with the attached drawings, in which.

DETAILED DESCRIPTION

Figure 1:
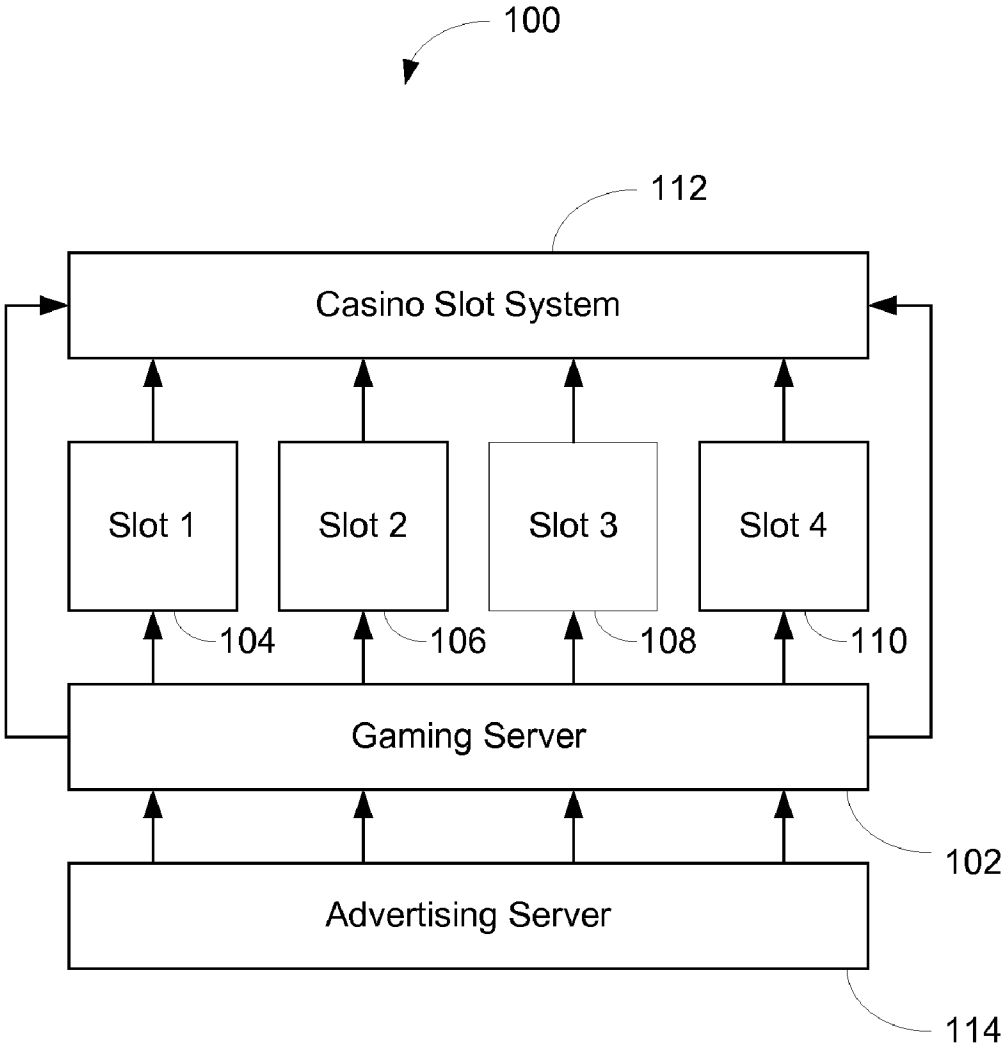
FIG. 1 is a diagram illustrating an example gaming system.

FIG. 1 is a diagram illustrating an example server based gaming system 100. System 100 can comprise a plurality of casino gaming machines. The casino gaming machines can, for example, be slot machines, video slot machines, video poker machines, video keno machines, video lottery terminal, or other types of mechanical or video casino gaming machines. In one embodiment casino gaming machines can be slot machines, of which slot machines 104-110 are shown by way of example. Slot machines 104-110 can comprise conventional video slot machines. Thus, slot machines 104-110 can comprise an input device, video monitor, money input device, money dispenser, and gaming chip/computer board. As in a conventional system, these components can be interfaced with a casino slot system 112. System 100 can also comprise a gaming server 102.

Server 102 can be, e.g., a computer, a stand alone gaming board, or multiple computers. Server 102 can include the rules for any of the one or more casino games that it provides. For example, server 102 can run software that includes casino games, such as slots, keno, bingo, poker, and any game of chance or skill, whether the game is a video or a reel based game. Additionally, as explained below, server 102 can include a random number generator for games of chance.

Thus, server 102 can be configured to provide additional game options to a player playing one of slot machines 104-110. In one embodiment a switch can be included in each video slot machines 104-110. A player begins play on one of slot machines 104-110, the player can be informed that they have the option to play other games than the one provided by the machine's own gaming board. For example, the switch can be an icon on the video gaming machine's video display or a physical switch. Once the player touches the icon or presses the physical switch as an indication of his or her interest to play other games, server 102 can take control of the video display and its input device, e.g., touch screen. Similarly, when the player is playing any of the additional games available via server 102 an icon or a switch button can be included to offer the option to go back to the slot machine's original game.

The mechanism for going back and forth between the original game and the additional game or games can be an apparatus that sits between the Original Equipment Manufacturer's (OEM's) gaming board and the video display, allowing two or more video sources to overlay pictures from two sources onto the video game machine's video display with one source coming from the original gaming board and the other from a gaming system. Thus, for example, when the player hits the icon, or activates the switch, control of the slot machine components can switch from the machine's gaming board to server 102.

Casino slot system 112 can be a networking system that interacts with the gaming chip in an existing gaming machine and devices that take in money, such as coin acceptors, bill validators, and ticket readers. Casino slot system 112 can also interact with devices that give out money, such a ticket printer or a coin release into a hopper. In this way the casino slot system 112 can keep track of how much money a player has put into existing slot machines 104-110 and how much money a player has taken out of existing slot machines 104-110. This information can be communicated to a gaming chip in existing slot machines 104-110. This information can also be communicated to server 102. In this way server 102 can know the player's account information when playing games that are located on server 102.

Thus, when a player indicated a desire to play a game controlled by server 102, server 102 can access the player's money remaining information from casino slot system 112. As the player plays the new game, money can be credited and debited to the player's account. When the player switches back over to the original game the account information can be passed back to casino slot system 112.

In one embodiment server based gaming system 100 can optionally include an advertising server 114. Advertising server 114 can deliver advertising content to a display or displays on one or more video game machines. In addition to storing advertising content, advertising server 114 can keep track of content delivered to each slot machine 104-110. This information can be used to, e.g., determine how much and which advertisers should pay for the advertising.

In return for watching advertising, players can, for example, be given greater odds for winning a promotion or jackpot on the slot machine 104-110. This gives the player an incentive to allow the advertising or select a slot machine 104-110 that has advertising.

The advertising can be targeted to the player using slot machine 104-110. For example, many casinos have player tracking systems that allow the casino to keep track of the player and determine information about the player. Information gained through enrolling in and using the player tracking system can be used to select which advertising to send to the player.

As shown in FIG. 1, in one embodiment, advertising server 114 can be a dedicated server that connects to slot machines 104-110 through gaming server 102. It will be understood, however, that in other embodiments advertising server 114 can connect to one or more of slot machines 104-110 without going through gaming server 102. Alternatively, in another embodiment, advertising server 114 can be part of gaming server 102.

Figure 4:
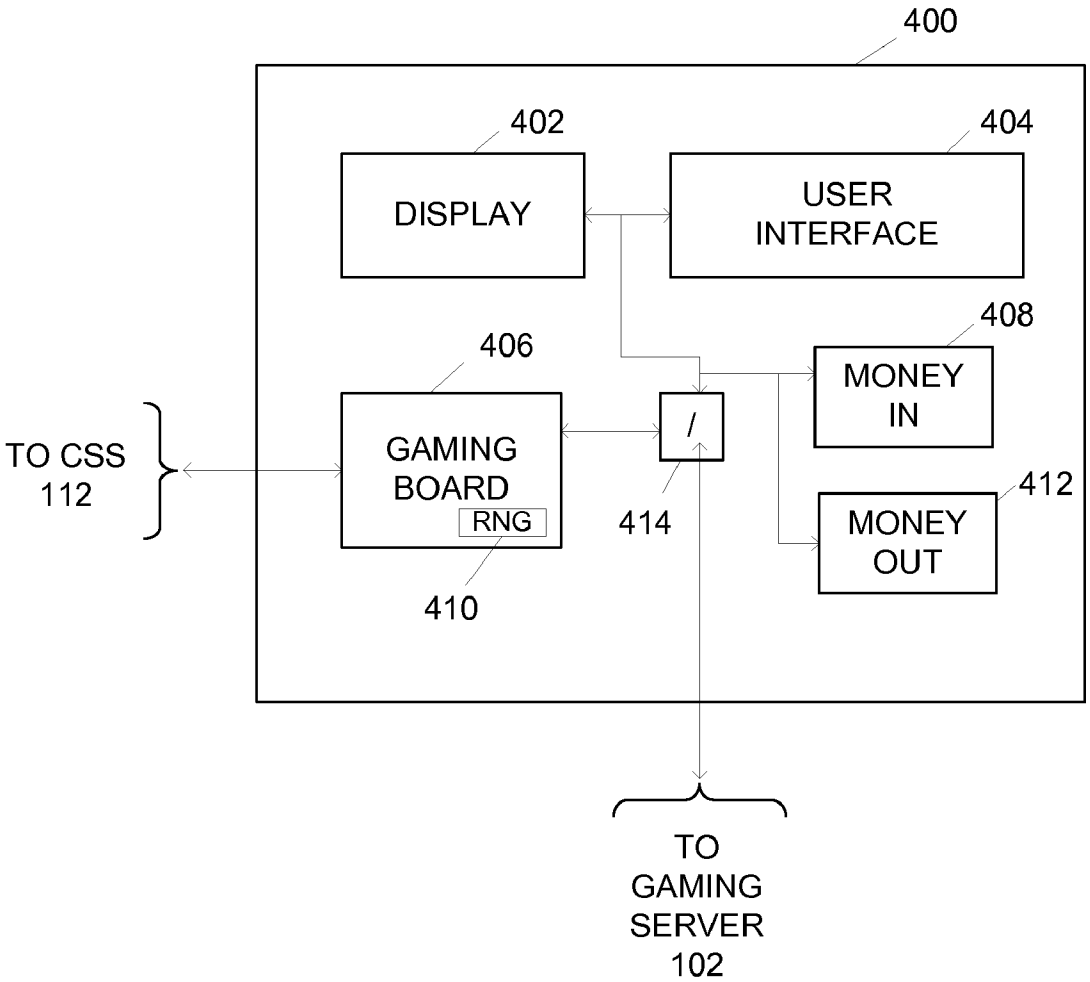
FIG. 4 is a diagram illustrating an example video slot machine.

FIG. 4 is a diagram illustrating an example video slot machine 400 configured in accordance with one embodiment. As can be seen, machine 400 can include a display 402 and a user interface 404. User interface 404 can comprise the various user input devices, such as buttons, key pads, etc., that allow the player to interact with machine 400. In certain embodiments, display 402 can comprise touch screen capability, which will also comprise part of user interface 404.

Display 402 and user interface 404 can be controlled by gaming board 406. Gaming board 406 can comprise the software required to implement a particular video slot machine game. For certain games, gaming board 406 can include a RNG 410.

Machine 400 can also include a money receiving device 408, such as a coin acceptor, bill validator or ticket in reader. Machine 400 can also include a money dispenser 412, such as hopper ticket out printer.

As mentioned above a switch 414 can be included in machine 400 for switching control of the display, and in some embodiments, user interface 404, between gaming board 406 and gaming server 102. As noted, switch 414 can be activated, e.g., by selecting an icon on display 402 or activating a switch included in user interface 404. Once switch 414 is activated, server 102 can take over control of display 402 and can access the players account information from casino slot system 112.

Figure 5:
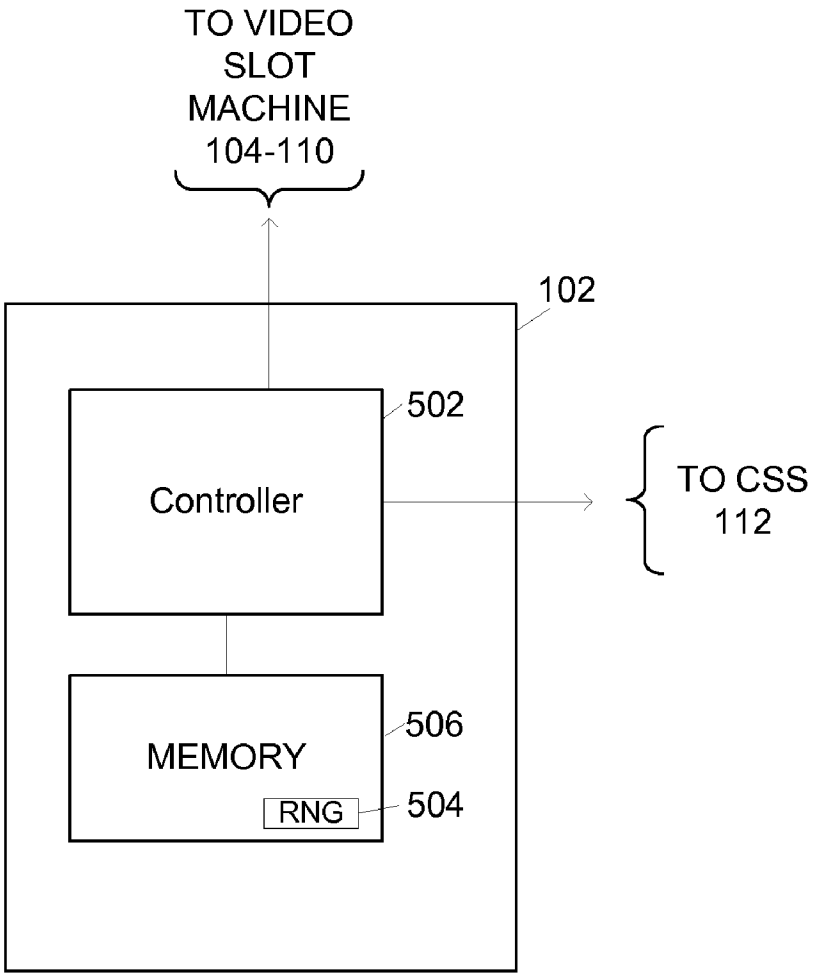
FIG. 5 is a diagram illustrating an example gaming server.

FIG. 5 is a diagram illustrating an example gaming server 102 in accordance with one embodiment. Server 102 comprises a controller 502 configured to control the operation of server 102. For example, controller 502 can comprise one or more microcontrollers, microprocessors, digital signal processors, math co-processors, etc., or some combination thereof.

Server 102 can also include a memory 506 configured to store instructions used by controller 502 to control the operation of server 102. Additionally, memory 506 can store the game software. This game software can be executed to allow a player to play a game using a terminal connected to server 102. For example, server 102 can be connected to a player's computer or terminal which can be located remotely from server 102. Memory 506 can also store software instructions for an RNG 504. RNG 504 can be separate from the software that produces the graphics or controls the reels, e.g., the gaming software. To determine the results of a game of chance the software can read a random number from the random number generator and map this to a result.

As an example, if the game was a simulation of roulette with a "roulette wheel" of 38 stops and the random number generator generated 38 numbers, each of these numbers could be mapped to one of the stops on the "roulette wheel," e.g., random number=1, result=1, random number=2, result=2, . . . random number=36, result=36, random number=37, result="0", random number=38, result="00".

Memory 506 can comprise volatile or non-volatile memory or some combination thereof. Thus, memory 506 can comprise one or more memory devices packaged in one or more packages. For example, depending on the embodiment, memory 506 can comprise DRAM, SRAM, EPROM, EEPROM, flash memory, etc. Further, memory 506 can include one or more hard drives or removable memory devices.

In one embodiment, server 102 can run software to control the reels of a slot machine. In another embodiment server 102 can control a touch screen in a casino gaming machine. In this way games that were not included in the casino gaming machine can be made available to a player. For example, a video slot machine can be used to play other games such as video keno, bingo, or poker.

In yet another embodiment the same server 102 can be programmed to control monitors, touch screens, and/or reel slot machines. In this way one server 102 can be used to control multiple types of gaming machines in a casino. Thus allowing casino owners and operators a great deal of flexibility by allowing a single server 102 to provide multiple games on multiple casino game machines, e.g., machines 104-110 using existing hardware and giving players access to a greater variety of games to play.

By using a network based system that includes a server 102 the life of existing gaming machines can be extended by allowing those machines to be used to play additional games, including the newest games or the most popular games. By passing data back and forth between an existing slot machine 104-110 and server 102 additional games can be added without the need to purchase an entirely new gaming machine. It can be difficult and expensive to get new casino gaming machines approved due to the strict licensing and investigation process. Thus, gaming approval is valuable. Therefore, extending the life of existing machines, thereby postponing the expense of purchasing new game machines that require these approvals is also valuable.

Figure 2:
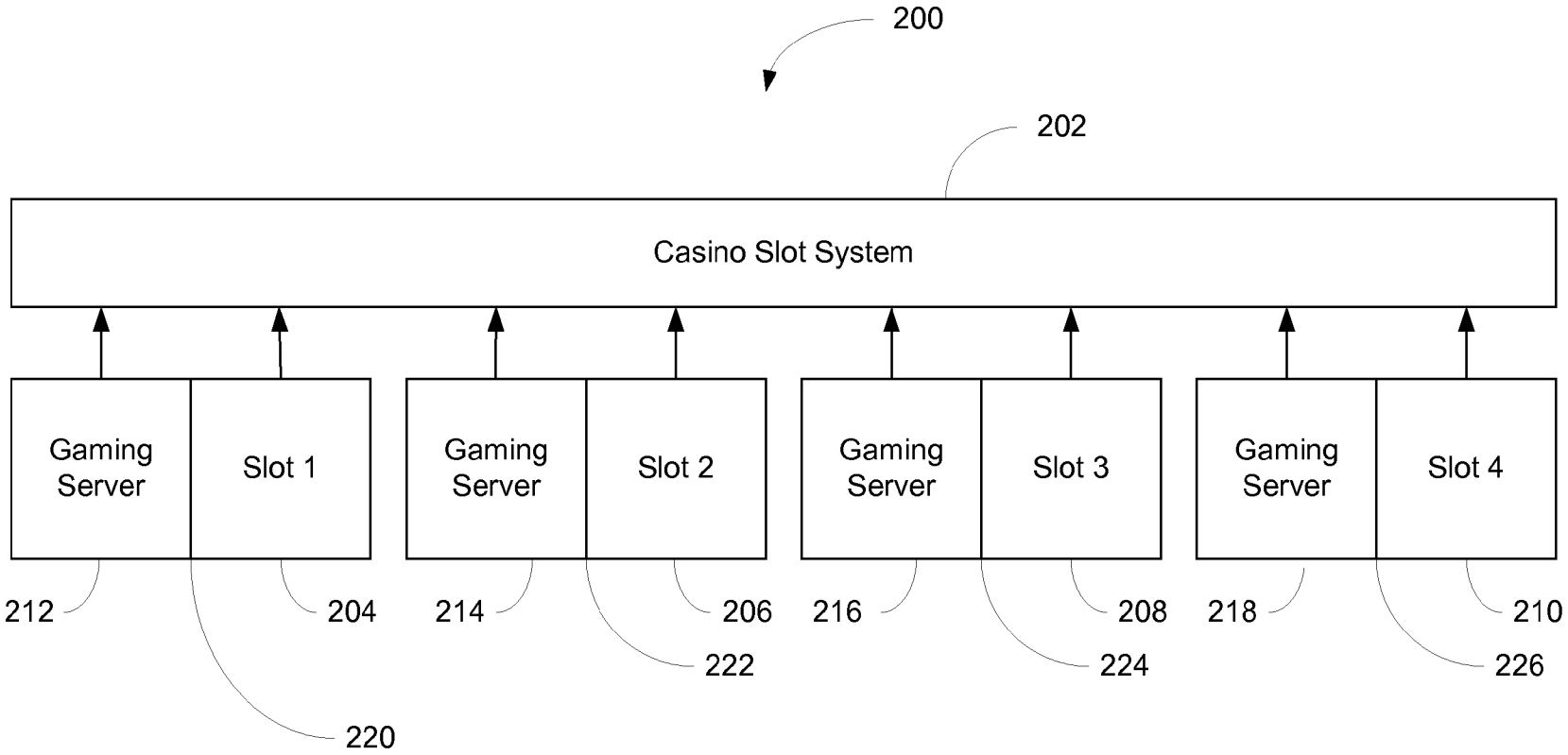
FIG. 2 is a diagram illustrating another example gaming system.

FIG. 2 is a diagram illustrating another example gaming system 200 configured in accordance with another embodiment. System 200 comprises a plurality of reel or video slot machines 204-210, which can be similar to machine 400 illustrated in FIG. 4. System 200 also comprises a plurality of gaming servers 212-218, which can be similar to server 102, however, unlike server 102, servers 212-215 can generally be located within, on, or very near existing slot machines 204-210 respectively.

In one embodiment one gaming server, e.g., server 212 can be co-located with an existing slot machine, e.g., machine 204, and still provide additional games to other existing slot machines 206-210. This can also be thought of as a server 102 that happens to be co-located with one of the slot machines 204-210 that is serves.

Each gaming server slot machine combination forms a gaming machine 220-226. Similar to the gaming system described with respect to FIG. 1, a player using a gaming machine 220-226 can play the original games located on existing slot machines 204-210 and the new games located on gaming servers 212-218, when playing on gaming machines 220-226 respectively. For example, in this way a video poker game can be added to each of video slot machines 204-210.

System 200 can also comprise a casino slot system 202, which can be interfaced with video slot machines 204-210 and gaming servers 212-218. As described above, when the player switches from one of machines 204-210 to one of the games supplied by servers 212-218, servers 212-218 can access the players account information on system 202 for use with the game being provided by servers 212-218. When the player switches back, the players updated account information can be passed back to system 202.

Figure 3:
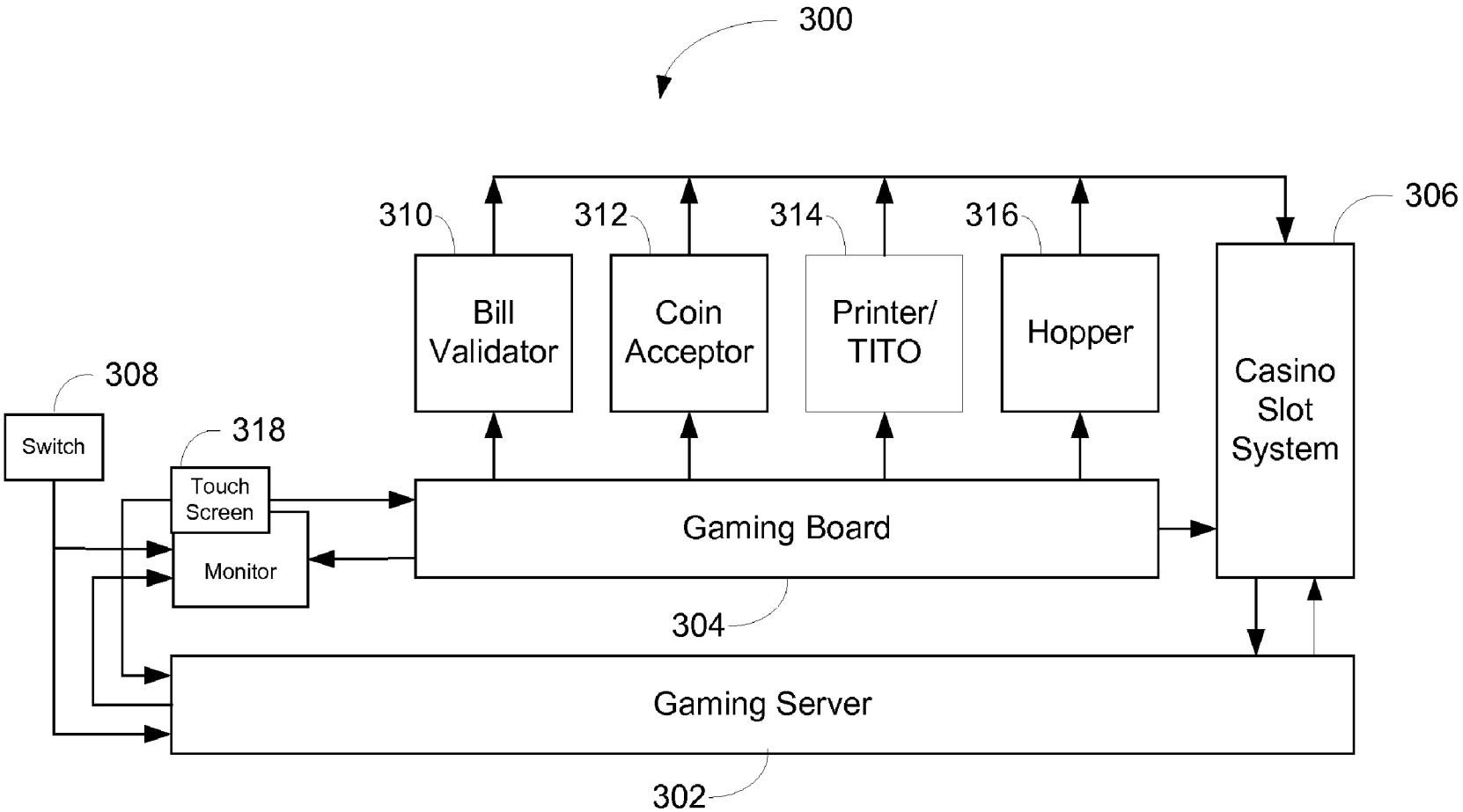
FIG. 3 is a diagram illustrating an example interaction between the gaming systems of FIGS. 1 and 2 with an existing slot machine.

FIG. 3 is a diagram illustrating an example interaction between the gaming systems of FIG. 1 or 2 with an existing slot machine. Gaming system 300 includes a new gaming device 302 that can be a server 102 or a new gaming computer 212. New gaming device 302 can interact with an existing slot machine's motherboard 304 using a casino slot system 306 and a switch 308. By using casino slot system 306 new gaming device 302 can gain information about a player's current balance from existing board 304 and money added to or withdrawn from the machine using bill validator 310, coin acceptor 312, printer 314, and the coin release into hopper 316.

For example, assume a player walks up to an existing slot machine 104. The player adds money to slot machine 104 using bill validator 310 or coin acceptor 312 and begins to play the existing game on slot machine 104. At some point the player decides to play a new game that is located on gaming system 302. Any money that the player still has from playing the existing game can be transferred to the gaming system 302 using casino slot system 306. Additionally, any money the player puts into the machine after switching to the new game using bill validator 310 or coin acceptor 312 can be credited to the new game and casino slot system 306.

If the player decides to switch back to the original game any money left can be credited back to existing slot's board 304 using casino slot system 306. In this way the player can keep playing without having to "cash out." Thus, the player can play whatever game he or she wants and it will appear to the player that all of the games are included in the machine, rather than an add on. When the player decides to stop playing he or she can cash out using existing slot's board 304 and printer 314 or hopper 316.

The player can select between games using switch 308. Switch 308 can be an icon on a video display or a physical switch and can control the connection between touch screen 318 and the existing slot's board 304 and new gaming system 302. Switch 318 can select between the existing slot's board 304 and new gaming system 302, allowing input and output from touch screen 318. Thus, a player can see and play games on the existing slot's board 304 and new gaming system 302. For example, when a player presses switch 318 new gaming device 302 can take control of touch screen 318. Conversely, if a player is already playing a game on new gaming system 302 switch 318 can allow the existing slot's board 304 to take control of touch screen 318 and allow the player to return to a game from the original slot machine.

Several examples have been discussed that include slot machines. It will be understood that other types of existing gaming machines can also be used with the systems and methods described herein. For example, additional games can be added to slot machines, video slot machines, video poker machines, video keno machines, video lottery terminals, or other types of mechanical or video casino gaming machines.

Figure 6:
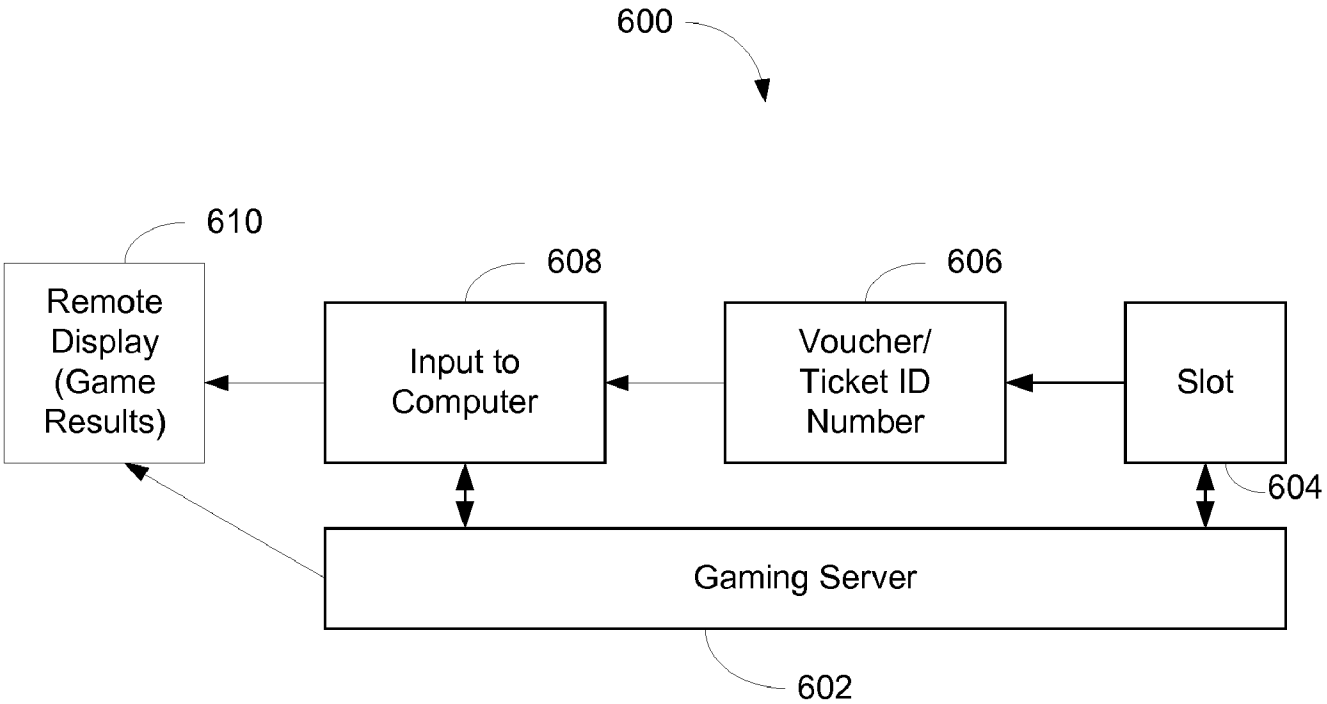
FIG. 6 is a diagram illustrating an example gaming system that includes a remote display.

FIG. 6 is a diagram illustrating an example gaming system 600 that includes a remote display 610 in accordance with one embodiment. Gaming system 600 can include a server 602 that can be, e.g., a computer, a stand alone gaming board, or multiple computers. Server 602 can include the rules for any of the one or more casino games that it provides. For example, server 602 can run software that includes casino games, such as slots, keno, bingo, poker, and any game of chance or skill, whether the game is a video or a reel based game. Additionally, server 602 can include a random number generator for games of chance.

Server 602 can be configured to provide remote game options to a player over, e.g., the internet using remote display 610. In one embodiment a player can purchase a voucher or ticket 606 using slot machine 604, for example, at a gaming location, such as a casino. It will be understood, however, that in another embodiment vouchers or tickets 606 can be purchased, e.g., at a gaming location, from dedicated voucher or ticket machines, or from employees at the gaming location. Thus the purchases can be made at a gaming location and therefore no purchases need to be made over the internet.

Gaming server 602 can display results to remote display 610 directly, or as an input to a computer 608 that can be connected to display 610. For example, Remote display 610 can be a television that simply displays results from gaming server 602. Alternatively, in another embodiment, remote display 610 can be connected to a computer. Gaming server 602 can provide input to the computer 608 that allows a player to get the results of one or more games. In one embodiment, the computer can be connected to server 602 using, e.g., the internet. A voucher or ticket identification number 606 can be input to the computer, this information can then be provided to server 602. In this way, server 602 can determine which game results to provide to which display 610, either directly, or as an input to the computer 608.

In one embodiment the results of any games played can be predetermined, for example, immediately after a voucher or ticket 608 has been purchased, e.g., while the player is still at the gaming location. Thus, the game of chance occurs while the player is at the gaming location, it is only the results that are displayed remotely. If a player wins, then the player can redeem the winning vouchers or tickets 606. This can be done, for example, by returning to the gaming location. Thus, the purchase of voucher or tickets 606, the results of the game or games, and collection of any winning can all occur at the gaming location.

While certain embodiments of the inventions have been described above, it will be understood that the embodiments described are by way of example only. Accordingly, the inventions should not be limited based on the described embodiments. Rather, the scope of the inventions described herein should only be limited in light of the claims that follow when taken in conjunction with the above description and accompanying drawings.

What is claimed is:

1. A gaming system, comprising:

a gaming server, the gaming server comprising one or more computing devices configured to execute a server-based game; and a gaming device, separate and independent of the gaming server, comprising:

an original equipment manufacturer's (OEM's) gaming board to execute an original game included in the OEM's gaming board; and a switch, operable by a player of the gaming device, to selectively configure the gaming device to offer either the original game executed on the OEM gaming board or the server-based game executed on the gaming server to the player of the existing gaming device; and a display unit for displaying images relating to the original game when the switch is in a first position and for displaying images relating to the server-based game when the switch is in a second position.

2. The system of claim 1, further comprising a touch screen device, wherein the switch is controlled by the player touching an icon displayed on the touch screen device.

3. The system of claim 1, further comprising a casino slot system in communication with the gaming device and the gaming server, the casino slot system configured to receive information indicative of an account balance from the gaming device;

maintain the account balance for the gaming device based on the received information; and transfer the maintained account balance from the gaming device to the gaming server in response to the player operating the switch to switch game play from the original game to the server-based game, wherein the transferred account balance is applied to the server-based game.

4. The system of claim 3, wherein the casino slot system is configured to transfer the account balance stored in the gaming server back to the gaming device in response to the player operating the switch to switch game play from the original game back to the server-based game, wherein the transferred back account balance is applied to the original game included in the gaming device.

5. The system of claim 1, wherein the gaming device comprises a video gaming device.

6. The system of claim 1, wherein the gaming device comprises a video slot device.

7. The system of claim 1, wherein the OEM's gaming board comprises a gaming chip.

8. The system of claim 1, further comprising a display device and an advertising server, the advertising server configured to:

transmit an advertisement to the gaming device through the switch;

wherein the advertisement is displayed on the display device.

9. The system of claim 8, wherein the advertising server is configured to keep track of the advertisement transmitted to the gaming device to determine how much or which advertiser should pay for the transmitted advertisement.

10. The system of claim 8, wherein the advertising server is configured to provide the advertisement to the gaming device to provide one or more incentives for the player to watch the advertisement, wherein the one or more incentives comprise at least one of greater odds of winning, a promotion or jackpot prize.

11. The system of claim 8, wherein the advertising server is configured to selectively target the advertisement to the player based on a player tracking system that maintains information about the player comprising selectively identifying which advertising to send to player.

12. The system of claim 1, further comprising a display unit and the switch is further configured to:

receive video data from the gaming server and the OEM gaming board; and overlay the received video data from the gaming server and the OEM gaming board onto the display unit.

13. The system of claim 1, further comprising:

a player interface unit to receive player input that controls play of the original game when the switch is in a first position and that controls play of the server-based game when the switch is in a second position.

14. The system of claim 1, further comprising:

a display unit for displaying images relating to the original game when the switch is in a first position and for displaying images relating to the server-based game when the switch is in a second position.

15. The system of claim 1, further comprising:

a remote display located remotely from the existing game machine and the game server, for providing a game result to the player.

16. A method for modifying an existing gaming device comprising:

connecting a switch to the existing gaming device configured at the time of manufacture to include:

an original equipment manufacturer's (OEM's) gaming board to execute an original game included in the gaming device;

connecting the switch to a gaming server separate and independent of the gaming device, the gaming server comprising one or more computing devices configured to execute a server-based game;

wherein connecting the switch unit to the gaming server and the gaming device allows a player of the existing gaming device to selectively configure the gaming device to offer either the original game executed on the OEM gaming board or the server-based game executed on the gaming server to the player of the existing gaming device; and displaying images relating to the original game when the switch is in a first position and for displaying images relating to the server-based game when the switch is in a second position.

17. The method of claim 16, wherein the switch is controlled by the player touching an icon displayed by a touch screen device coupled to the existing gaming machine.

18. The method of claim 16, further comprising connecting a casino slot system to the gaming device and the gaming server to control money received from the player at the gaming device comprising:

receiving, by the casino slot system, information indicative of the money received from the player at the existing gaming device;

maintaining an account balance for the player as the player plays the original game;

providing the maintained account balance to the gaming server in response to the player operating the switch to stop playing the original game and to begin playing the server-based game; and applying the transferred account balance to the server-based game.

19. The method of claim 18, further comprising:

using the casino slot system to transfer the account balance back to the existing gaming device in response to the player operating the switch to stop playing the server-based game and to begin playing the original game; and applying the transferred back account balance to the original game.

20. The method of claim 16, wherein the existing gaming device comprises a video gaming device.

21. The method of claim 16, wherein the existing gaming device comprises a reel slot machine.

22. The method of claim 16, wherein the existing gaming device comprises a video lottery terminal.

23. The method of claim 16, further comprising connecting an advertising server to the existing gaming device to provide an advertisement to the gaming device comprising:

transmitting the advertisement to the gaming device through the switch; and displaying the advertisement to the player via a display unit on the existing gaming device.

24. The method of claim 23, further comprising using the advertisement server to provide one or more incentives for the player to watch the advertisement, wherein the one or more incentives comprise greater odds for winning, a promotion or a jackpot.

25. The method of claim 23, further comprising using the advertisement server to selectively target the advertisement to the player based on a player tracking system that maintains information about the player comprising selectively identifying which advertising to send to the player.

26. The method of claim 16, further comprising using the advertisement server to keep track of the advertisement transmitted to the existing gaming device to determine how much or which advertiser should pay for the advertisement.

27. The method of claim 16, further comprising:

receiving video data, via the switch, from the gaming server and the OEM gaming board; and overlaying the video data from the gaming server and the OEM gaming board onto a display unit located on the existing gaming device.

28. The method of claim 16, further comprising:

displaying images relating to the original game when the switch is in a first position and displaying images relating to the server-based game when the switch is in a second position.

29. The method of claim 16, further comprising:

providing a game result to a remote display located remotely from the existing game machine and the gaming server.

* * * * *